US005612770A

United States Patent [19]

Bandai et al.

[11] Patent Number: 5,612,770

[45] Date of Patent: Mar. 18, 1997

[54] DEVELOPING DEVICE WITH PARTITION MEMBER OF VARYING LENGTH

[75] Inventors: Yasuhito Bandai; Kazumasa Makino; Soichiro Nishimura, all of Nagoya, Japan

[73] Assignee: Brother Kogyo Kabushiki Kaisha, Nagoya, Japan

[21] Appl. No.: 434,340

[22] Filed: May 2, 1995

[30] Foreign Application Priority Data

Jul. 27, 1994 [JP] Japan ..... 6-175313

[51] Int. Cl.[6] ..... G03G 15/06

[52] U.S. Cl. ..... 399/254; 399/263

[58] Field of Search ..... 355/200, 245, 355/260, 215; 118/653

[56] References Cited

U.S. PATENT DOCUMENTS

| | | | |
|---|---|---|---|
| 4,864,349 | 9/1989 | Ito | 118/653 X |
| 5,075,728 | 12/1991 | Kobayashi et al. | 355/260 |
| 5,103,264 | 4/1992 | Bhagat | 355/245 |
| 5,103,765 | 4/1992 | Owada et al. | 118/653 |
| 5,124,751 | 6/1992 | Fukui et al. | 118/653 X |
| 5,188,057 | 2/1993 | Ishikawa et al. | 118/657 |
| 5,287,148 | 2/1994 | Sakemi et al. | 355/245 |
| 5,325,163 | 6/1994 | Nishio | 355/260 |

FOREIGN PATENT DOCUMENTS 64-52182 2/1989 Japan .

*Primary Examiner*—Sandra L. Brase
*Attorney, Agent, or Firm*—Oliff & Berridge

[57] ABSTRACT

A partition wall for separating a developing chamber from a toner agitating chamber in an electrostatic developing device includes a high wall portion confronting a toner discharge opening of a toner cartridge, and low wall portions formed on either side of the high wall portion. Toner is discharged from the toner discharge opening of the toner cartridge into the agitating chamber. Toner is then sent over the partition wall and into the developing chamber by rotation of an agitator in the agitating chamber. Toner in the central portion of the agitating chamber goes over the high wall portion, and toner in the side portions of the agitating chamber goes over the low wall portions. Accordingly, a uniform amount of toner is supplied to all points along the length of a developing sleeve in the developing chamber, and hence to all points along the length of a photosensitive drum confronting the developing sleeve.

27 Claims, 7 Drawing Sheets

DEVELOPING DEVICE WITH PARTITION MEMBER OF VARYING LENGTH

BACKGROUND OF THE INVENTION

1. Field of the Invention

The present invention relates to an electrostatic image forming apparatus such as a printer, a copying machine, a facsimile system, and the like. More particularly, the invention relates to a structure for transporting a toner supplied from a toner supply cartridge into a developing chamber.

2. Description of the Related Art

A conventional image forming apparatus employs a dry developing method, in which development is achieved by supplying toner to a developing region on the surface of a photosensitive drum. In such an apparatus, the surface of the photosensitive drum is uniformly charged by a charger, then light beams corresponding to image data are projected onto the surface of the photosensitive drum. The light beams form an electrostatic latent image on the surface of the photosensitive drum. Next, a toner, in the form of fine particles magnetized by a developing device, are developed onto the electrostatic latent image to form a toner image which is transferred onto a recording sheet.

For example, in an image forming apparatus disclosed in Japanese Patent Laid-open No. 64-52182, a developing device (developing tank) adjacent a photosensitive drum includes a developing sleeve incorporating a magnetic roller in its inner portion. The developing sleeve carries toner and a carrier on its circumferential surface. A toner supply roller supplies toner to the developing sleeve. In a toner supply chamber (make-up chamber), which is separated from the developing chamber by a partition wall, a rotating agitating member supplies the toner into the developing chamber. The toner supply chamber stores new, unused toner, which is supplied from a toner source. The toner in the toner supply chamber is sent over the partition wall and into the developing chamber by rotation of the agitating member.

As the recording operation is repeatedly performed, as described above, toner is consumed and it becomes necessary to supply additional toner to the toner supply chamber. To add additional toner, the entire process unit or the whole casing of the developing device may be replaced, or a lid on the toner supply chamber may be opened and toner from a toner make-up box may be emptied into the toner supply chamber to replenish the toner supply.

Replacing the entire process unit or the entire developing device, however, can be very expensive. In order to prolong the interval between replacement of the developing device to reduce the need for replacement, it is necessary to enlarge the toner supply chamber so that a larger amount of toner can be stored. The larger toner supply chamber, however, causes the apparatus as a whole to become larger, which can be undesirable.

On the other hand, when toner from a toner make-up box is added to the toner supply chamber, toner can be easily scattered around and may frequently soil hands and clothes.

In order to solve such problems it is known to provide a member at the side of a toner supply chamber, which allows a toner cartridge containing toner to be detachably attached to the toner supply chamber. Using this system, a replacement operation may be performed wherein a new toner cartridge is attached to the developing device, and an aperture between the cartridge and the toner supply chamber is opened so that the cartridge communicates with the toner supply chamber. Toner from the toner cartridge may thereby be supplied to the toner supply chamber as the recording operation is carried on, and the chance of scattering toner is greatly reduced.

In the above-described toner cartridge system, in order to prevent toner from spilling out of the cartridge while the cartridge is handled, it is necessary to seal the aperture on the cartridge with a shutter. Since it is very difficult to ensure a good seal of the shutter when the aperture is large, the aperture is formed to have the minimum required size in a central portion of the cartridge in its longitudinal direction.

In the above toner cartridge system, toner is discharged into the toner supply chamber from the aperture in the central portion of the toner cartridge. The toner in the toner supply chamber is sent over a partition wall and into the developing chamber by an agitating member. Under such conditions, the pushing force on the toner from the toner cartridge is easily transmitted to the central region of the toner in the toner supply chamber, and the toner in the central region of the toner supply chamber advances straight from the aperture on the toner cartridge into the developing chamber. However, the pushing force on the toner from the toner cartridge is not easily transmitted to the toner present at side portions of the toner supply chamber, and therefore the toner at the side portions cannot easily go over the partition wall. Accordingly, toner is not well supplied to the end portions of the developing sleeve, and hence to the photosensitive drum. As a result, the recording density on a recording sheet may be too light at the side portions. If this condition persists, clogging of the toner may begin at the side portions, and the flow of the toner may gradually become worse, even in the central portion. As a result, the recording density may become insufficient across all of the recording sheet.

If the height of the partition wall is decreased, toner at the side portions is able to easily go over the partition wall, and stagnation of the toner can be prevented. However, toner in the central portion receives less resistance, and too much toner is sent from the central portion of the toner supply chamber into the developing chamber. As a result, an imbalance of the density of the resulting image may occur.

SUMMARY OF THE INVENTION

It is an object of the present invention to provide an image forming apparatus with a simple structure capable of uniformly supplying toner onto a photosensitive drum so that no deterioration of recording quality occurs.

In order to achieve the above mentioned object, an image forming apparatus embodying the present invention includes a cylindrical developing sleeve incorporating a magnetic roller, the developing sleeve having an axis parallel to the axis of a photosensitive drum. The developing sleeve is rotatably mounted in an opening formed in a developing chamber casing adjacent the circumference of the photosensitive drum. The apparatus also includes a toner agitating chamber and structure for detachably attaching a toner cartridge containing a supply of toner. The toner cartridge has a discharge opening for discharging toner from inside the cartridge into the agitating chamber. The toner agitating chamber includes toner agitating means for agitating the toner that is supplied from the discharge opening in the cartridge and for sending the toner into the developing chamber.

A partition wall having a high wall portion confronting the discharge opening of the toner cartridge and low wall portions on opposite side of the high wall portion that do not confront the discharge opening separates the developing chamber from the toner agitating chamber. The discharge opening in the toner cartridge may be formed in the central portion of the cartridge with respect to a longitudinal direction.

In an image forming apparatus embodying the invention, as described above, toner is discharged from the discharge opening in the toner cartridge into the toner agitating chamber. Rotation of an agitating member in the toner agitating chamber causes the toner to advance straight from the discharge opening, over the high wall portion of the partition wall, and into the developing chamber. The toner in the remaining portions of the toner agitating chamber is allowed to go over the low wall portions of the partition wall and into the developing chamber. Accordingly, the supply of the toner from the toner agitating chamber to the developing chamber becomes substantially uniform in all portions. As a result, the developing sleeve, and hence the photosensitive drum, can be supplied with a uniform amount of toner, and deterioration in recording quality on the recording medium can be prevented.

In an image forming apparatus embodying the invention, the width of the high wall portion may be approximately equal to the width of the frontage of the opening of the toner cartridge. Therefore, toner in the central portion of the toner agitating chamber is prevented from being sent into the developing chamber too fast, and the supply of the toner from the toner agitating chamber to the developing chamber becomes substantially uniform in all positions.

Further, a partition wall of an image forming apparatus embodying the invention may include sloped portions, wherein the partition wall height decreases gradually from the centrally located high wall portion toward the low wall portions. Therefore, toner is prevented from suddenly changing its flow pattern at interface between the high wall portion and the low wall portions, thus the toner flows smoothly.

Further, because an image forming apparatus embodying the invention may be designed so that the agitating member causes toner in the central portion of the agitating chamber to go over the high wall portion and toner in side portions to go over the low wall portions, the supply of the toner from the toner agitating chamber to the developing chamber becomes even whether from the central portion or from the both side portions. As a result, a uniform amount of toner is supplied to the developing sleeve, and hence to the photosensitive drum and deterioration in recording quality on the recording medium may be prevented regardless of the reference position for recording on the recording medium.

BRIEF DESCRIPTION OF THE DRAWINGS

A preferred embodiment of the present invention will be described in detail with reference to the following figures wherein.

DETAILED DESCRIPTION OF PREFERRED EMBODIMENTS

Figure 1:
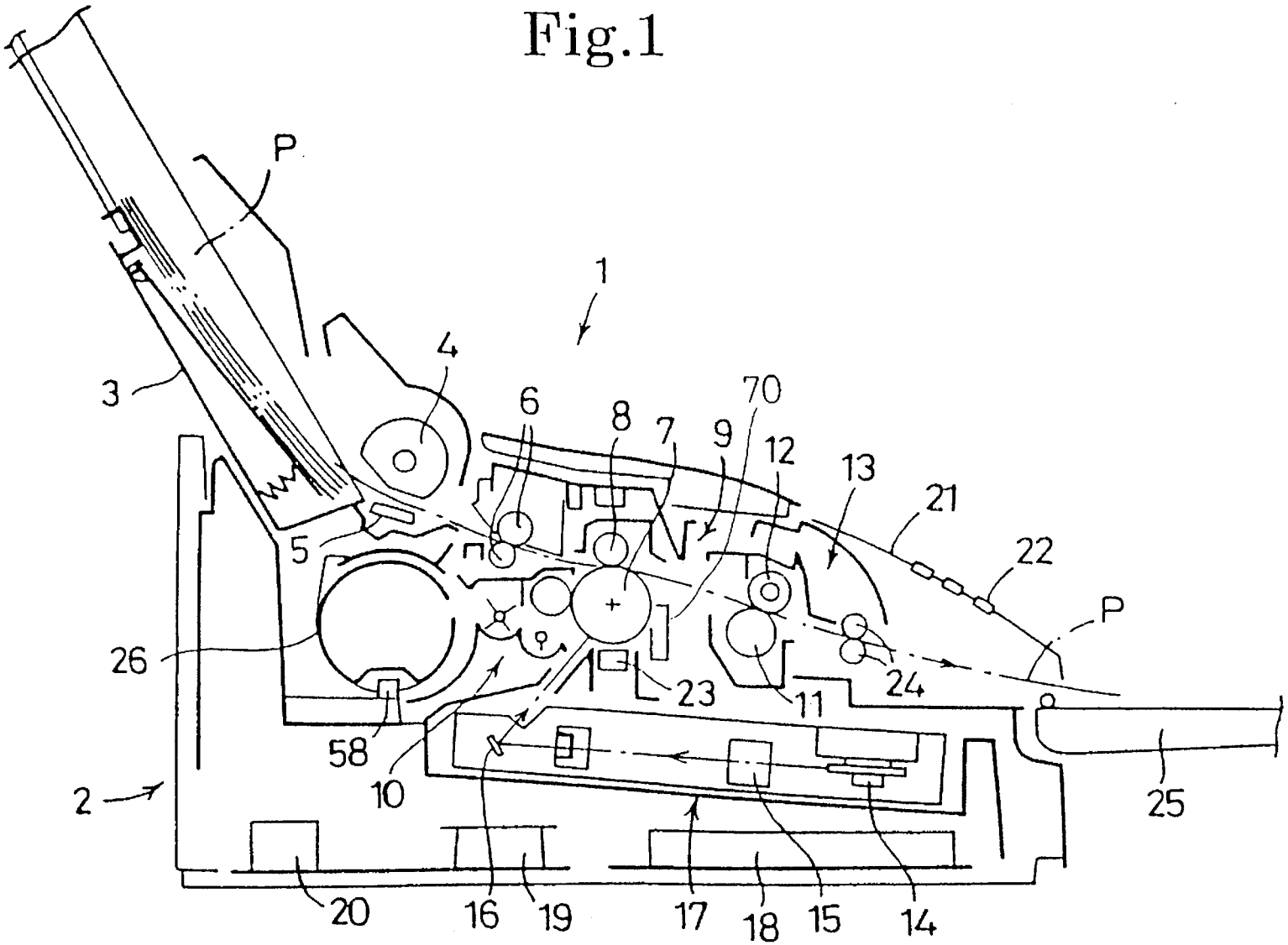
FIG. 1 is a sectional side view schematically showing a laser printer.
Figure 2:
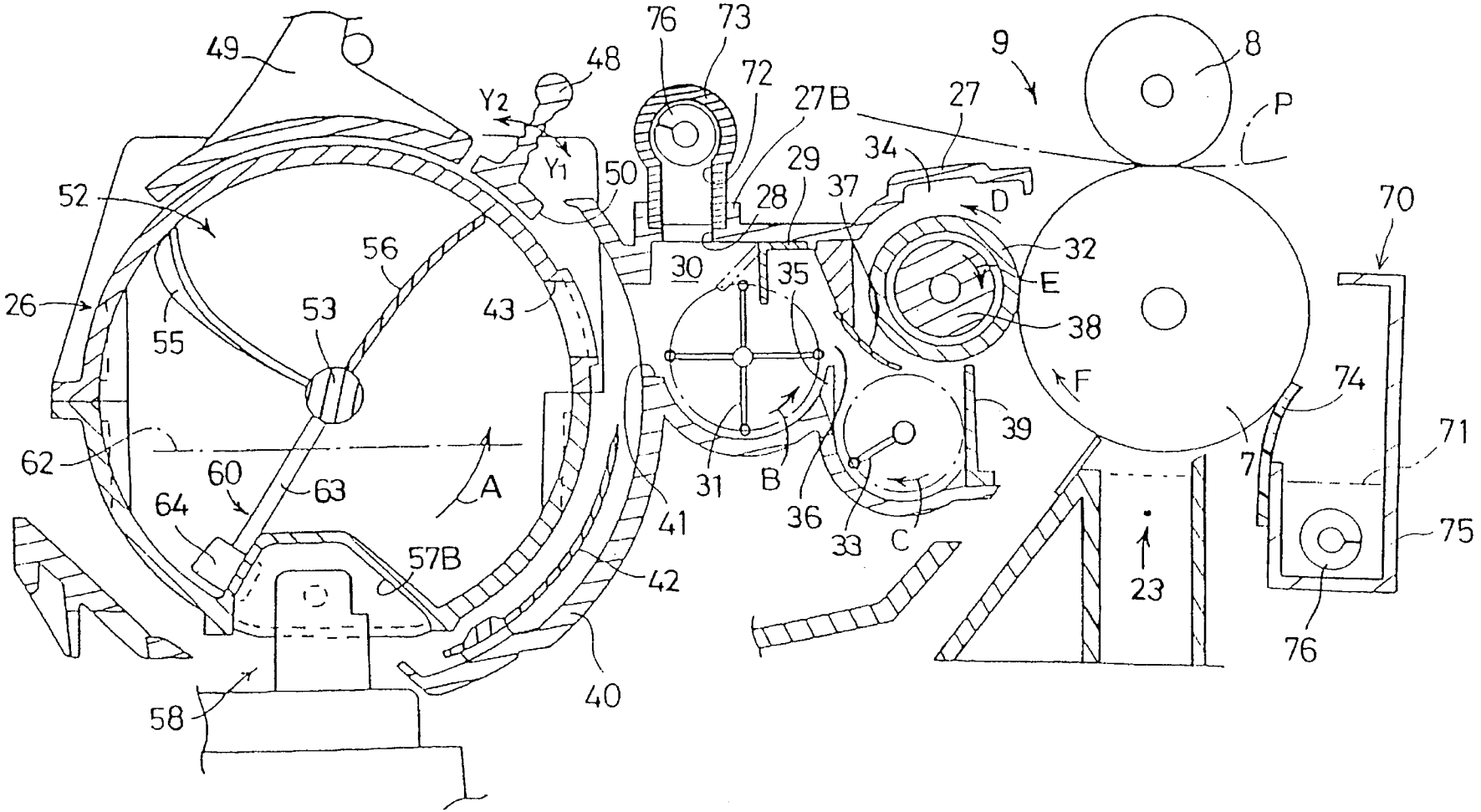
FIG. 2 is a partial sectional side view of a main portion of a developing device.

An embodiment of the present invention will be described below. FIG. 1 is a schematic sectional side view of a laser printer 1. FIG. 2 is a partial sectional side view of a developing portion of a developing device 10. In FIG. 2, the portion of a partition wall 35 between an agitating chamber 30 and a developing chamber 34 is cut at a point close to the side face of a casing 27 of a developing device 10.

The laser printer 1 embodying the present invention has a paper supply cassette 3 detachably attached to one side of the top portion of a casing 2. The paper supply cassette 3 is adapted such that sheets of recording paper P may be piled up in the paper supply cassette 3. The paper P is separated into individual sheets by a paper feed roller 4 and a separating pad 5. Each sheet thus separated is supplied to a photosensitive unit 9 comprising a photosensitive drum 7, a transfer roller 8, and a pair of feed rollers 6. Adjacent the photosensitive unit 9 is a developing device 10, which will be described in detail later. On the opposite side of the photosensitive unit 9 a cleaning device 70 is mounted adjacent the photosensitive drum 7. A fixing unit 13, comprising a heating roller 11 and a press roller 12, is also provided adjacent the photosensitive unit 9.

Below the photosensitive unit 9 is a scanner unit 17, comprising a laser beam emitting portion 14, a lens 15, a reflecting mirror 16, control boards 18 and 19, and a power supply unit 20. A keyboard 22 equipped with a plurality of control buttons is provided on a cover 21.

Light beams are emitted from the scanner unit 17 in accordance with image data transmitted from an external device such as a computer (not shown). The light beams are projected onto the surface of the photosensitive drum 7, which has previously been charged by a charger 23, to form an electrostatic latent image on the surface of the photosensitive drum 7.

A magnetized developing sleeve 32 (refer to FIG. 2) in the developing device 10 is rotated, and a toner, in the form of fine particles, is applied to the electrostatic latent image to develop a toner image on the latent image. Thereafter, the toner image is transferred to a recording paper P supplied between the photosensitive drum 7 and the transfer roller 8. The toner image is fixed on the recording paper P by the application of heat and pressure by a fixing unit 13. The recording paper is then discharged into a discharge paper tray 25 of the laser printer 1 through a pair of paper discharge rollers 24. After the toner image has been transferred to the recording paper P, any used toner still attached to the surface of the photosensitive drum 7 is recovered by the cleaning device 70.

The casing 27 of the developing device 10, which may be made of a plastic material, is separated by a partition wall 35 into an agitating chamber 30, serving as the toner supplying chamber, and a developing chamber 34, as shown in FIG. 2. An opening 36 is formed in the partition wall 35 so as to confront the total length of one side of the peripheral surface of the developing sleeve 32. On top of the casing 27 is a connecting portion 27B for connecting a used toner intake opening 28 to the agitating chamber 30. Used toner 71 is recovered by the cleaning device 70, and a transport pipe 73 having a recycle path 72. The used toner 71 is supplied to the agitating chamber 30 via the intake opening 28. Further, a regulating seat 29 is attached to the interior of the upper portion of the casing 27. The regulating seat 29 has an L-shaped cross section and is formed of a film having elasticity, such as a PET (polyethylene terephthalate), and which is permeable to magnetism.

Figure 5:
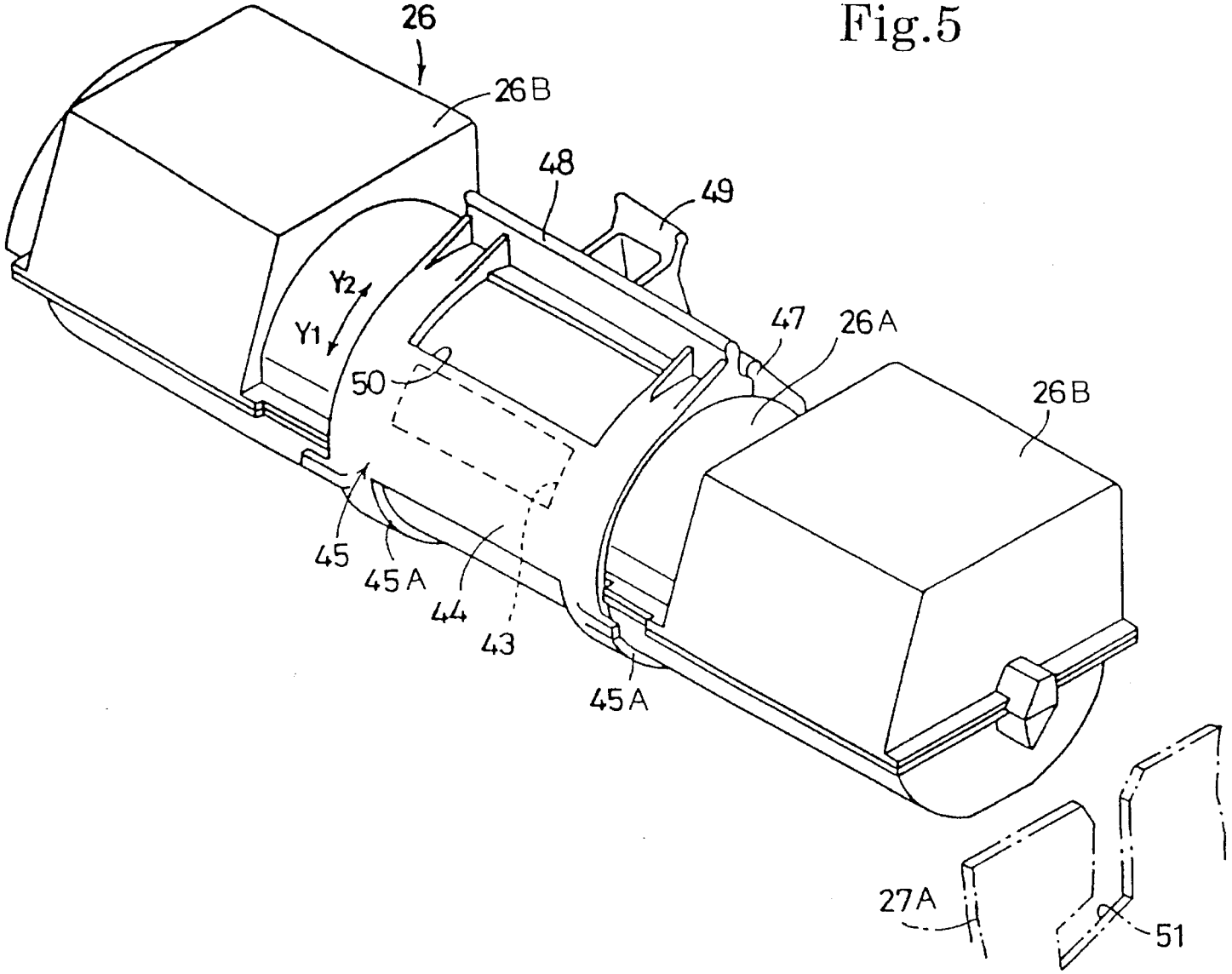
FIG. 5 is a perspective view from one direction of a toner cartridge.

A toner cartridge 26 contains and supplies nonmagnetic or magnetic toner, as a portion of the developer, to the agitating chamber 30. The cartridge 26 is removably mounted on a pair of brackets 27A (one of which is shown in FIG. 5 provided on the left and right sides of the casing 27.

Toner 62, is provided to the agitating chamber 30, where it is agitated by a second agitator 31, which may be formed of rotating vanes. The second agitator 31 rotates in the direction of the arrow B, to agitate the toner such that the toner is spread along the total length of the opening 36. The regulating seat 29 is disposed such that its free end is positioned within the rotating locus of the vanes of the second agitator 31. While the second agitator 31 rotates, toner is prevented from advancing past the regulating seat 29, hence intake space is maintained at the lower portion of the intake opening 28.

An arcuate partition wall 40 is provided on the side of the agitating chamber 30 opposite the partition wall 35. A toner charging opening 41, having a rectangular shape, is formed in the arcuate partition wall 40 at the center of the agitating chamber 30 in its horizontal longitudinal direction (i.e., the direction perpendicular to the paper surface of FIG. 2). A second shutter 42, which is formed of a thin metal (such as aluminum) plate and which has a cross section in the form of an arc, is provided as a shutter for closing the toner charging opening 41. The second shutter 42 is disposed on the side of the arcuate partition wall 40 toward the toner cartridge 26 such that both left and right end portions thereof are slidably supported along guide grooves, not shown.

Figure 3:
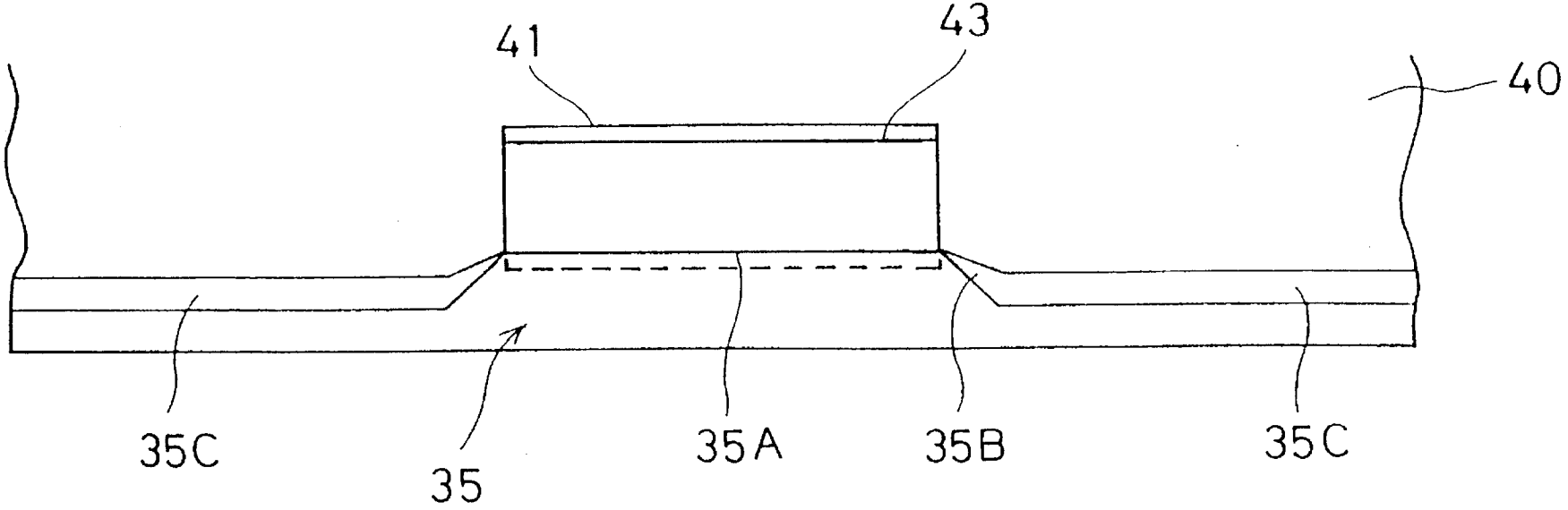
FIG. 3 is an enlarged plan view of a partition wall.

As shown in FIG. 2 and FIG. 3, the partition wall 35 has a high wall portion 35A, which confronts the toner charging opening 41 (and the toner discharge opening 43 disposed in the middle portion 26A of the toner cartridge 26). The high wall portion 35A has a width substantially equal to or greater than the width of the frontage of the toner charging opening 41 (and the toner discharge opening 43). The high wall portion 35A also has a height that is equal to or greater than a height of the lower side of the toner charging opening 41. Sloped portions 35B of the partition wall 35 have wall heights that decrease gradually from the sides of the high wall portion 35A toward both end portions. The partition wall also includes low wall portions 35C that are disposed between the sloped portions 35B and opposite ends of the partition wall 35. The partition wall 35 is made thinner toward its tip than its base, as shown in FIG. 2. In addition, the sloped portions 35B and the low wall portions 35C are provided with a step so that they have a sharp edge along their tips, as shown in FIG. 3. This design prevents toner from collecting on an otherwise flat horizontal portion along the top edge of the partition wall 35.

A developing sleeve 32 incorporating a magnetic roller 38 in its inner portion is rotatably mounted in the developing chamber 34. A first agitator 33 is disposed below the developing sleeve 32 and may be formed of a rotating vane and the like. One side of the peripheral surface of the developing sleeve 32 is disposed so as to confront the peripheral surface of the photosensitive drum 7. A regulating member 37, which may be formed of an elastic film such as a PET (polyethylene terephthalate) film which is permeable to magnetism, may be mounted in the opening 36 between the agitating chamber 30 and the developing chamber 34. The middle portion of the regulating member 37 extends down into the developing chamber 34 so as to confront the peripheral surface of the developing sleeve 32. The free end of the regulating member 37 is disposed close to the outside of the rotating locus of the first agitator 33.

The toner used in the present embodiment may either be the so-called 2-composition toner in which the magnetic carrier accounts for 95–98% by weight and the nonmagnetic toner accounts for 2–5% by weight or be the so-called 1.5-composition toner in which the magnetic carrier accounts for 30–80% by weight and the magnetic toner accounts for 20–70% by weight.

The second agitator 31 rotates in the direction of the arrow B as shown in FIG. 2, and moves the toner in the agitating chamber 30 from its bottom to the opening 36. The first agitator 33, while rotating in the direction of the arrow C, agitates the toner supplied from the opening 36 and mixes the toner with magnetic carrier previously contained in the developing chamber 34. The first agitator 33 causes toner to pass over the bottom of the developing chamber 34 and then up to the bottom surface of the developing sleeve 32. While the developing sleeve 32 rotates in the direction of the arrow D, a magnetic roller 38 (having N poles and S poles alternately arranged in the radial direction) in the inner portion of the developing sleeve 32 rotates in the direction of the arrow E. The developing sleeve 32 is disposed close to the photosensitive drum 7, which rotates in the direction of arrow F.

A trimmer plate 39 may be provided at a position within the developing chamber 34 close to the peripheral surface of the photosensitive drum 7. The trimmer plate 39 adjusts the thickness of the layer of the toner carried by the magnetic carrier on the circumferential surface of the developing sleeve 32.

Figure 4:
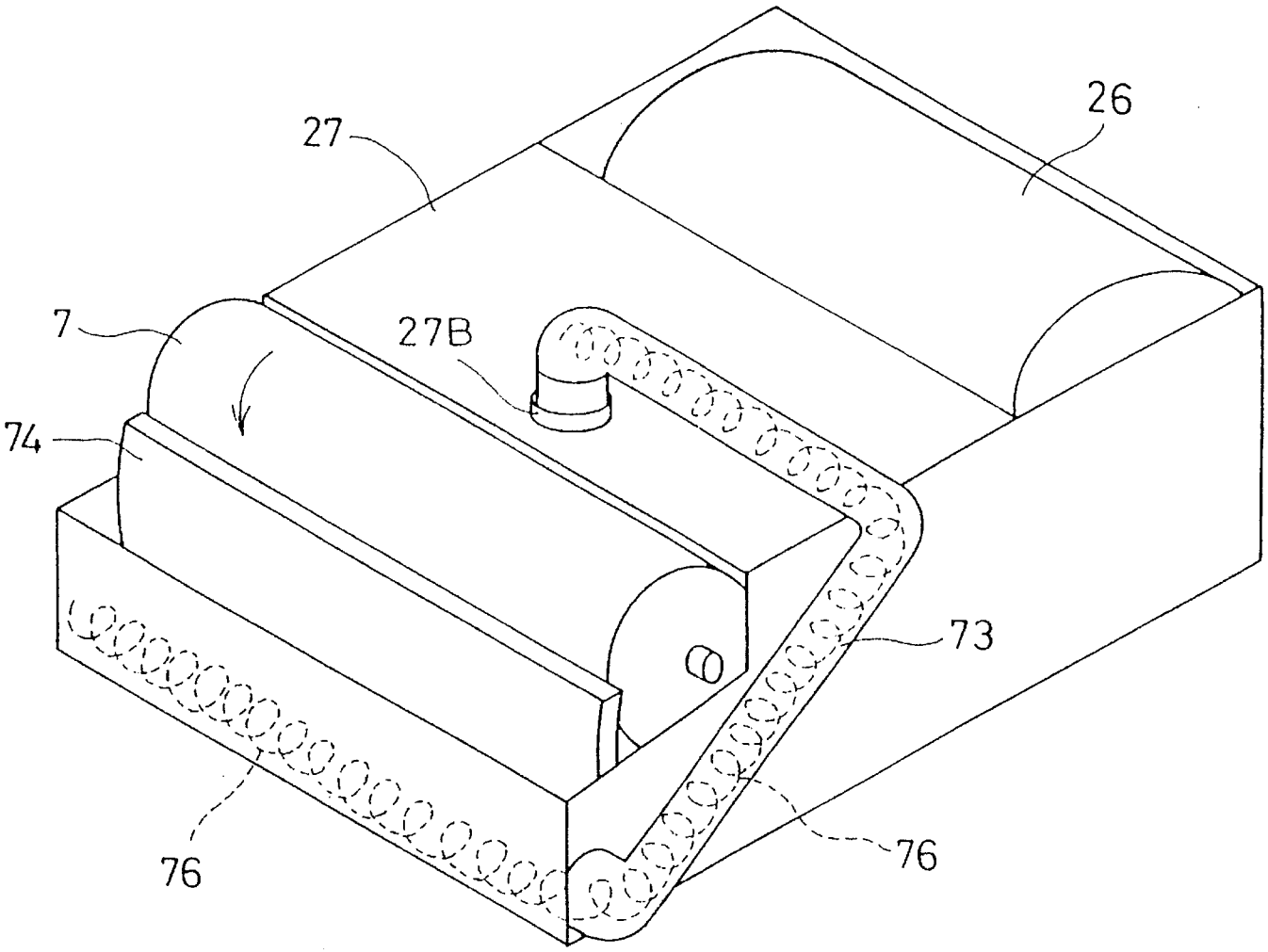
FIG. 4 is a perspective view showing an outline of a device for recycling used toner.

The cleaning device 70 comprises a cleaning blade 74, which may be formed of rubber, such as urethane rubber, which comes in tight contact with the surface of the photosensitive drum 7 after a toner image has been transferred to a recording medium. The cleaning blade 74 recovers the used toner 71 still attached to the surface of the photosensitive drum 7. A casing 75 contains the used toner 71 that has been recovered from the photosensitive drum 7. Further, in order to reuse the recovered used toner 71, the casing 75 is provided with a long and narrow spiral shaped member 76 for transporting used toner 71 back to the agitating chamber 30 by way of a transport pipe 73. Toner moves through the transport pipe 73 along a recycle path 72. The spiral member 76, rotates within to carry used toner to the agitating chamber 30, the transport pipe 73 as shown in FIG. 4.

Referring now to FIG. 2 and FIG. 5–FIG. 8, the structure of the toner cartridge 26 containing the toner 62 will be described.

Figure 6:
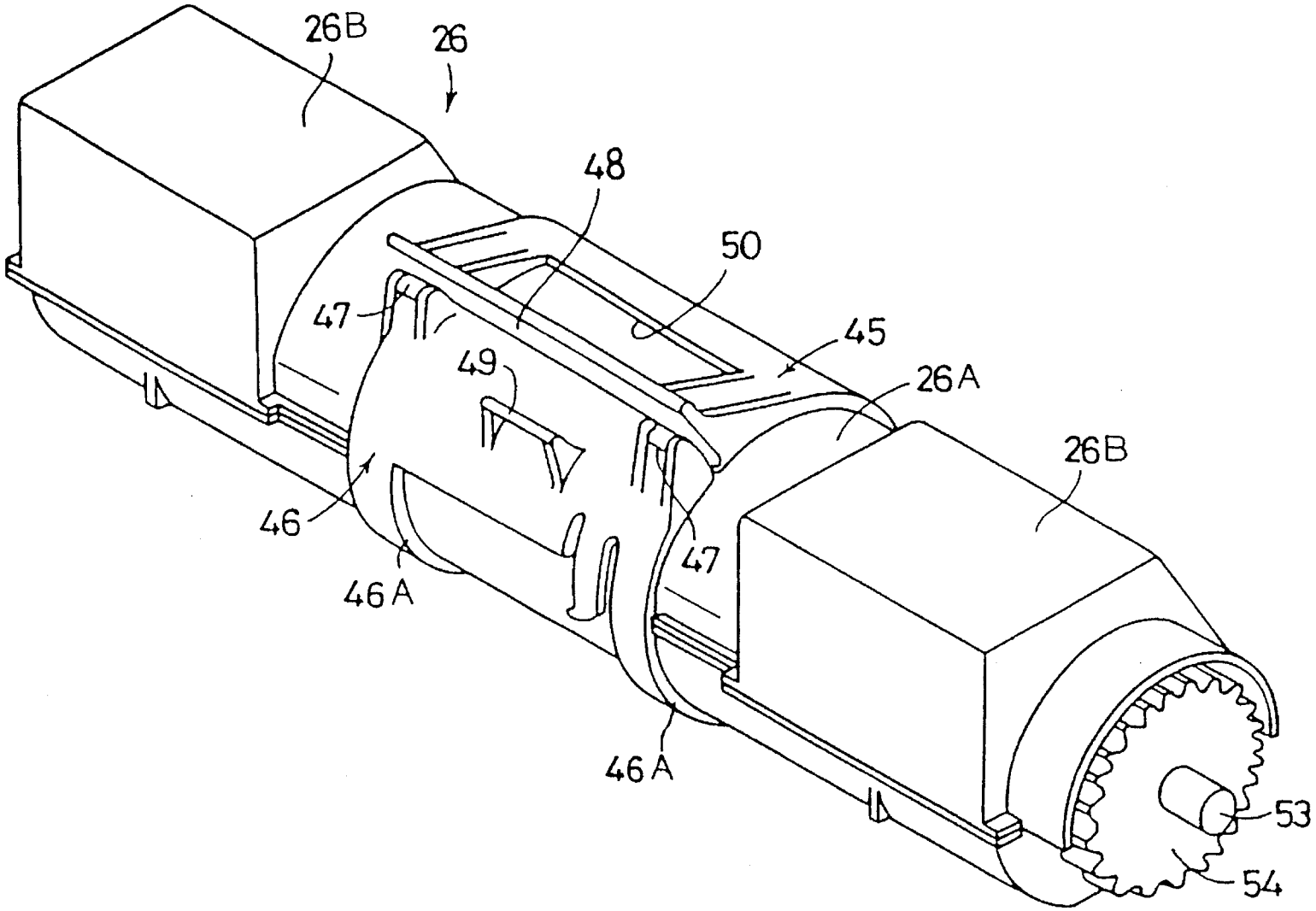
FIG. 6 is a perspective view from another direction of the toner cartridge.

The toner cartridge 26, as shown in FIG. 5 and FIG. 6, has a lower half shaped into a circular arc, and an upper half shaped into a rectangular form. The toner cartridge 26 is divided into side portions 26B located on left and right sides of the toner cartridge (in its longitudinal direction). A middle portion 26A is located in the middle and shaped into a circular cylindrical form. The toner cartridge generally has the shape of a cylinder elongated in the horizontal direction. The whole body of the toner cartridge 26 may be formed of semitransparent brown acrylic resin, polycarbonate resin, or the like. The toner cartridge 26 may be removably mounted on a pair of brackets 27A (only one of which is shown in FIG. 5) projecting from the casing 27 of the developing device 10. When mounted on the casing 27, the middle portion 26A of the toner cartridge 26 is disposed adjacent and concentric to the arcuate partition wall 40 of the casing 27.

A toner discharge opening 43 is formed in one side of the middle portion 26A of the toner cartridge 26. The toner discharge opening 43 confronts the toner charging opening 41 of the agitating chamber 30. A first shutter 44, which serves as a member for closing the toner discharge opening 43, is provided in a first holding member 45, which is slidably mounted on the toner cartridge 26. The dimensions of the toner discharge opening 43 are substantially the same as, or smaller than, the dimensions of the toner charging opening 41, and the height of the lower side of the toner discharge opening 43 is the same as, or higher than, the height of the lower side of the toner charging opening 41.

More specifically, the first holding member 45 and a second holding member 46 are shaped into a circular form than surrounds the circumference of the middle portion 26A when viewed from the side. The first and second holding members 45,46 are coupled together at a hinge portion 47 at their upper portions, and are removably engaged by engagement claws and engagement holes (both not shown) formed at the leg portions 45A and 46A at their lower portions. The first holding member 45 and the second holding member 46 are provided with projecting knob portions 48 and 49, respectively, and the wide face of the first holding member 45 serves as the first shutter 44. When the first holding member 45 is rotated in the direction Y1 shown in FIG. 5, an upper opening 50 aligns with the toner discharge opening 43 to open the toner discharge opening 43. When the first holding member 45 is rotated in the direction Y2, the first shutter 44 closes the toner discharge opening 43. When the first holding member 45 is rotated in the direction Y1, engagement portions (not shown) on the first holding member 45 engage claws on both left and right sides of the second shutter 42 to thereby rotate the second shutter 42 downward so that the toner charging opening 41 is opened.

Although a detailed description will not be given, when the toner cartridge 26 is removed from the developing device 10, the first shutter 44 on the side of the toner cartridge 26 and the second shutter 42 on the side of the agitating chamber 30 are locked so that they may not rotate to accidentally open the toner discharge opening 43 or the toner charging opening 41. Further, when the toner cartridge 26 is loaded in supporting grooves 51 in the pair of brackets 27A, 27A, the first shutter 44 and the second shutter 42 are unlocked. Elastic seal members made of a felt material, or the like, may be placed on the circumference of the toner charging opening 41 and the toner discharge opening 43, so that when the shutters 42 and 44 are shut, the portions between the openings 41 and 43 and the shutters 42 and 44, respectively, are sealed off. In addition, when the openings 41 and 43 are open, the seal members abut each other so that toner 62 may not come out unexpectedly.

An agitator 52 is provided within the toner cartridge 26, as shown in FIG. 2. One end of a revolving shaft 53 of the agitator 52 projects from one side of the toner cartridge 26, and a gear 54 is attached thereto, as shown in FIG. 6. The revolving shaft 53 is rotated in the direction of the arrow A in FIG. 2 by a main motor through a driving mechanism (not shown). The revolving shaft 53 is provided with flexible first agitating members 55 on its left and right sides, which may be made of polyester resin film (polyethylene terephthalate film) or the like. A flexible second agitating member 56 is aligned with the toner discharge opening 43 and may be similarly made of polyester resin film (polyethylene terephthalate film). The agitating members are arranged out of phase by an angle of approximately 90 degrees about the revolving shaft 53.

Figure 8:
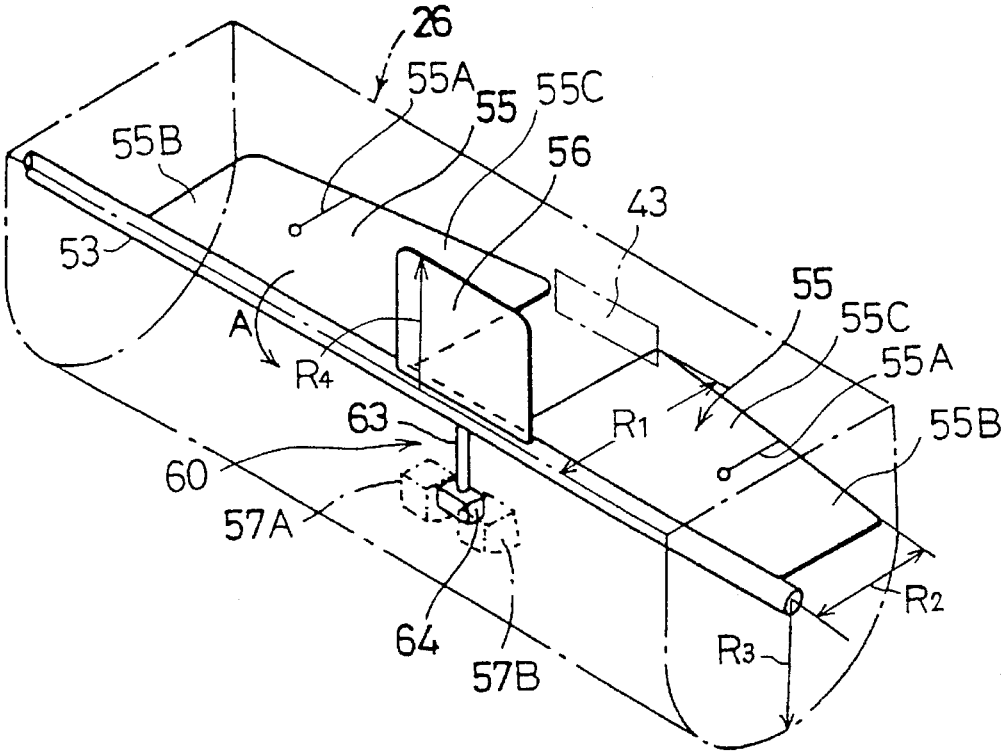
FIG. 8 is a perspective view showing the agitators within the toner cartridge.

Each of the first agitating members 55 extend radially from the shaft 53 and are shaped into the form of a trapezoid, i.e., the radial dimension R1 closer to the toner discharge opening 43, is longer than the radial dimension R2 further away from the toner discharge opening 43, as shown in FIG. 8. In addition, when the radius to the inner wall of the cylindrical portion of the toner cartridge 26 is represented by R3, the dimensions are such that R1>R2>R3. The radial dimension R4 of the second agitating member 56, which serves for both agitating and carrying out the toner, is set to be substantially equal to R3.

In another embodiment, each of the first agitating members 55 may be provided with a slit 55A cut in the radial direction at a position on the agitating members aligned with the boundary between the cylindrical middle portion 26A and the rectangular side portions 26B of the toner cartridge 26. The slit 55A divides the first agitating members 55 into a portion 55C closer to the central portion, and a portion 55B closer to the outer portion, wherein the portions 55C and 55B can be bent independently of each other. The radial dimension R2 of the outer portion 55B is set so that it can substantially reach both the front and rear corners of the rectangular ceiling surface of the rectangular side portions 26B on each of the left and right sides of the toner cartridge 26.

Both of the first agitating members 55 are spaced apart so that they will not collide with residual toner detecting portions 57A and 57B, which will be described later. The second agitating member 56 is formed to have a width larger than the spacing between the first agitating members 55.

Figure 7:
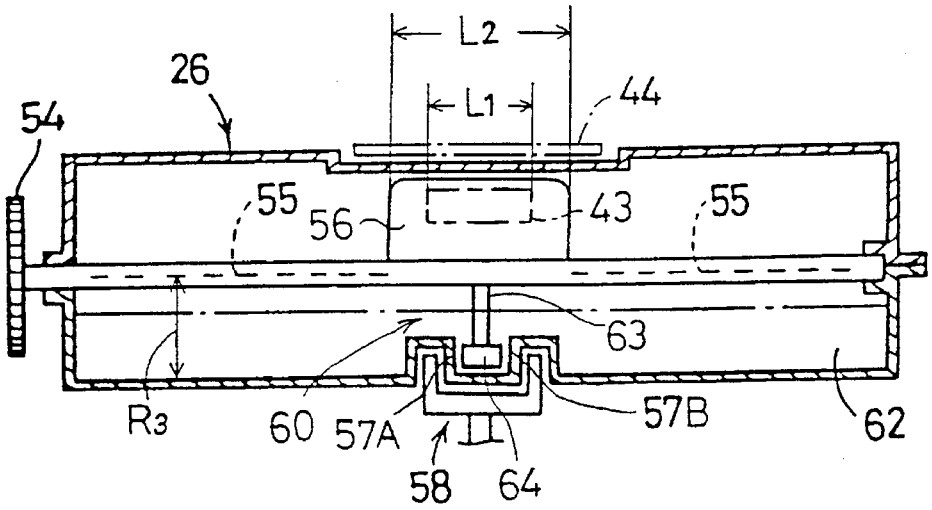
FIG. 7 is a sectional view of a toner cartridge showing agitators within the toner cartridge.

As shown in FIG. 7 and FIG. 8, a pair of residual toner detecting portions 57A and 57B, which may be transparent and which project radially inward, are provided on the bottom surface in the center of the toner cartridge 26. A toner sensor 58, such as a photointerrupter formed of a light emitting portion and a photosensing portion, may be provided adjacent the residual toner detecting portions, 57A and 57B. The toner sensor emits light a beam that is aimed through the toner detecting portions 57A, 57B. When toner is present at the bottom of the toner cartridge 27, the toner blocks the light beam. When no toner is present between the residual toner detecting portions 57A, 57B, the light beam passes through both toner detecting portions 57A, 57B and is received by the photosensing portion.

In addition, a wiping member 60 may be attached to the revolving shaft 53, so that rotation of the shaft 53 causes the wiping member 60 to pass through the space between the pair of residual toner detecting portions 57A and 57B to wipe toner 62 off the inner wall surfaces of the residual toner detecting portions 57A and 57B. In one embodiment of the wiping member 60, cleaning brushes may be attached to both sides of a block 64 attached to the end of an arm 63 so that the inner wall surfaces of the residual toner detecting portions 57A and 57B are wiped by the cleaning brushes. In an alternate embodiment, the inner wall surfaces of the residual toner detecting portions 57A, 57B may be wiped by flexible films (not shown).

The wiping member 60 may be used to help detect residual amounts of the toner. That is, when the wiping member 60 rotates in the direction of the arrow A, as shown in FIG. 8, and passes through the space between the pair of residual toner detecting portions 57A and 57B, it scoops up the toner 62. At this time, the light emitted from the light emitting portion can be received by the photosensing portion. Then, as the toner 62 falls into the space between the pair of residual toner detecting portions 57A and 57B to fill up the space, the light will be blocked. When there is a large amount of toner remaining in the toner cartridge 26, the ON period, T, of the toner sensor 58 will be short. The ON period, T, will become longer as the residual amount of toner becomes smaller. When the quantity of the toner 62 becomes very small, the light will be received continuously. Thus, a control device (not shown) can detect the residual amount of toner from the information about the time T.

Toner supplying operations from the toner cartridge 26 and the cleaning device 70 to the agitating chamber 30 will be described below. The supplying operation of unused toner 62 from the toner cartridge 26 will first be described referring to FIG. 2 and FIG. 8.

When the shaft 53 of the agitator 52 rotates in the direction of the arrow A, toner 62 is scooped up from the middle portion 26A by the second agitating member 56 and is discharged from the toner discharge opening 43 through the toner charging opening 41 formed in the partition wall 40 and into the agitating chamber 30. Consequently, the quantity of toner remaining in the middle portion 26A of the toner cartridge 26 decreases.

Because the first agitating members 55 have a longer radial dimension near the middle portion 26A of the toner cartridge 26 and a shorter radial dimension near the sides of the toner cartridge 26B, as shown in FIG. 8, when the first agitating members 55 rotate along the inner peripheral surface of the toner cartridge 26 (which has a constant radius R3) the inside portions having the larger radius are bent by a greater angle than the outside portions having the smaller radius, as shown in FIG. 2. Accordingly, a slant is produced in the first agitating members 55 such that the inside portions are behind the outside portions. As a result, toner 62 is pushed toward the middle by the slanting surfaces.

Further, by providing a suitable phase difference of approximately 90 degrees between the first agitating members 55 and the second agitating member 56, as shown in FIG. 8, the operation of the first agitating member 55 in pushing toner 62 toward the middle portion 26A of the toner cartridge 26, and the operation of the second agitating member 56 in supplying toner to the agitating chamber 30 can be carried out with an appropriate time interval therebetween. As a result, the action of the first agitating members 55 in pushing toner 62 toward the middle portion 26A of the toner cartridge 26 can be promoted, and even if only a small quantity of toner 62 remains on the bottom of the toner cartridge near the side portions, toner 62 will still be supplied to the agitating chamber 30.

In addition, even if the toner discharge opening 43 is provided only in the middle portion of the toner cartridge 26, toner 62 will be prevented from remaining at the side portions of the toner cartridge 26, and the residual toner detecting portions 57A and 57B on the bottom under the toner discharge opening 43 are prevented from malfunctioning.

Further, when the width L2 of the second agitating member 56 is greater than the width L1 of the discharge opening 43, as shown in FIG. 8, a flexible baffle plate (not shown), made of a material such as a PET (polyethylene terephthalate) film may be fixed to the inner wall face of the toner cartridge 26 above the toner discharge opening 43 such that as the free end portion of the second agitating member 56 rotates upward, it is rubbed by the baffle plate. This will cause the toner 62 on the top face of the free end of the second agitating member 56 to be sprung out through the toner charging opening 41, thus enhancing the supplying operation.

Since the outer portion 55B of the first agitating members 55 can bend independently of the inner portions 55C due to the slits 55A, the inner portions 55C can wipe the upper half of the cylindrical middle portion 26A of the toner cartridge 26. Further, although the upper outer portions 26B of the toner cartridge 26 are shaped into a flat rectangular form, the outer portions 55B of the first agitating members 55 can adapt themselves to the form of the inner wall. A suitable number of slits 55A may also be made at intervals in the axial direction of the revolving shaft 53.

The toner supplying operation from the cleaning device 70 to the agitating chamber 30 will now be described with reference to FIG. 2 and FIG. 4.

Toner 62 supplied to the agitating chamber 30 is made even in particle size by having masses, if any, crushed by operation of the second agitator 31. The even particles of toner are then supplied into the developing chamber 34 over the partition wall 35. Toner 62 supplied to the developing chamber 34 through the opening 36 is agitated and mixed with a magnetic carrier to form the developer by the first agitator 33, which rotates in the direction of the arrow C. At the same time, the toner receives frictional electricity and is held onto the developing sleeve 32, which rotates in the direction of the arrow D. When the toner on the developing sleeve 32 comes into contact with the photosensitive drum 7, which has an electrostatic latent image formed thereon, the toner in the developer is transferred to the electrostatic latent image to form a toner image. The toner image is then transferred by the transfer roller 8 to a recording paper P supplied between the photosensitive drum 7 and the transfer roller 8.

Any used toner 71 that remains on the surface of the photosensitive drum 7 after the toner image has been transferred to the recording paper P is recovered and put into the casing 75 by the cleaning blade 74 of the cleaning device 70. The recovered used toner 71 is then transported, by means of the rotating spiral member 76, through the recycle path 72 to the intake opening 28 of the agitating chamber 30. The recovered used toner falls by its own weight into the agitating chamber 30 through the intake opening 28. At the same time, toner within the agitating chamber 30, agitated by the second agitator 31, is stopped from moving in front of the intake opening 28 by the regulating seat 29. As a result, a space for taking in the recovered used toner is maintained under the intake opening 28, and the used toner 71 transported from the cleaning device 70 can be smoothly supplied into the agitating chamber 30.

Transportation of toner into the developing chamber 34 will now be described with reference to FIG. 2 and FIG. 3.

Toner 62 supplied from the toner discharge opening 43 in the middle portion 26A of the toner cartridge 26, and used toner 71 supplied from the cleaning device 70, are scooped up toward the opening 36 as the second agitator 31 rotates in the direction of the arrow B. Because toner 62 from the toner cartridge 26 and toner 71 from the cleaning device 70 is supplied to the central portion of the agitating chamber, there is a larger quantity of toner in the central portion than in the side portions of the agitating chamber 30.

Because a pushing force of the toner from the toner cartridge 26 is readily transmitted to the toner in the central portion of the agitating chamber 30, toner can easily go over the high wall portion 35A, even if it is considerably high, because of the larger quantity of toner in the central portion. Although a pushing force of the toner from the toner cartridge 26 is not transmitted well to the toner at the side portions of the agitating chamber 30, because the low wall portion 35C of the partition wall 35 is low in height, the toner at the side portions can easily go over the low wall portion 35C. Thus, toner in the agitating chamber 30 is sent into the developing chamber 34 over the partition wall 35 in a substantially uniform manner along the entire length of the developing sleeve 32. Therefore, the developing sleeve 32, and hence the photosensitive drum 7, in the developing chamber 34, are uniformly supplied with the toner. As a result, the recording quality on the recording paper P suffers no deterioration.

Because the width of the high wall portion 35A is substantially equal to the width of the frontage of the toner discharge opening 43 (and the toner charging opening 41 in the partition wall 40), toner in the central portion of the agitating chamber 30 is not sent into the developing chamber 34 more than necessary, and the supply of toner from the agitating chamber 30 to the developing chamber 34 becomes substantially uniform in all positions. Further, because sloped portions 35B are provided between the high wall portion 35A and the low wall portions 35C, no sudden change in the flow of toner is produced where the wall height changes from the high wall portion 35A to the low wall portion 35C, hence the toner flows smoothly.

Although, in the above described embodiment, the contour of the partition wall 35 includes a high wall portion 35A where the height is constant, sloped portions 35B where the height of the wall descends gradually and linearly, and low wall portions 35C where the height is constant, it is generally only required that the height of the partition wall is high at the central portion and gradually decreases toward the ends. For example, the high wall portion and the low wall portions are not required to be of constant height, but rather they may be in the form of a slant or a gentle arc. Further, the sloped portion 35B may be in the form of a gentle concave curve.

In addition, because the central portion of the agitating chamber 30 is supplied with toner 71 from the cleaning device 70 through the intake opening 28, the central portion of the high wall portion 35A of the partition wall 35 may be made even higher to account for the amount of used toner 71 received from the cleaning device 70.

It is also possible to set the reference position of recording to an end portion of the apparatus, and to set the toner discharge opening 43 of the toner cartridge 26 to a side portion adjacent the reference position of recording. In this case, the same effects as obtained in the above embodiment will be obtained by having the high wall portion disposed to confront the toner discharge opening, and to form the rest of the partition wall into the low wall portion.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. A developing device, comprising:

a developing chamber confronting a photosensitive drum;

a developing sleeve adjacent a peripheral surface of the photosensitive drum;

a first agitating member mounted in the developing chamber for agitating toner supplied to the developing chamber;

an agitating chamber, wherein toner is supplied to the agitating chamber from a toner source;

a second agitating member mounted in the agitating chamber for agitating toner in the agitating chamber and for supplying toner from the agitating chamber to the developing chamber; and a partition member located between the agitating chamber and the developing chamber, the partition member having a height that varies along a length of the partition member such that all points along the length thereof toner can be supplied by the second agitating member over the partition member from the agitation chamber to the developing chamber.

2. The developing device of claim 1, wherein toner is supplied into a central portion of the agitating chamber, and wherein the partition member comprises a centrally located high wall portion, and first and second low wall portions located on opposite sides of the high wall portion.

3. The developing device of claim 2, wherein the partition member further comprises first and second sloped portions, the first sloped portion being located between the high wall portion and the first low wall portion, the second sloped portion being located between the high wall portion and the second low wall portion.

4. The developing device of claim 3, wherein the first and second sloped portions have a height that continuously varies along the length of the partition member between the high wall portion and the first and second low wall portion, respectively.

5. The developing device of claim 4, wherein top edges of the first and second sloped portions form concave curves.

6. The developing device of claim 3, wherein a thickness of the partition member is greater at a base thereof than at a top edge thereof.

7. The developing device of claim 1, wherein the partition member has at least one high wall portion and at least one low wall portion.

8. The developing device of claim 1, wherein the agitating chamber further comprises a toner charging opening, wherein toner is supplied to the agitating chamber through the toner charging opening, and wherein said partition member comprises a high wall portion located on the partition member to confront the toner charging opening.

9. The developing device of claim 8, wherein a height of the high wall portion is substantially equal to a height of a lower edge of the toner charging opening.

10. The developing device of claim 8, wherein the toner charging opening is centrally located in the agitating chamber, wherein the high wall portion is centrally located along the partition member, and wherein the partition member further comprises first and second low wall portions located on opposite sides of the high wall portion.

11. The developing device of claim 8, wherein the high wall portion has a width substantially equal to a width of the toner charging opening.

12. The developing device of claim 8, wherein the toner source comprises a toner cartridge, wherein toner is supplied to the agitating chamber from a discharge opening in the toner cartridge, the discharge opening in the toner cartridge being aligned with the toner charging opening in the agitating chamber and having a size that is equal to or less than a size of the toner charging opening, and wherein a width of the high wall portion is substantially equal to or greater than a width of the discharge opening in the toner cartridge.

13. The developing device of claim 12, wherein a height of the high wall portion is substantially equal to a height of a lower edge of the discharge opening in the toner cartridge.

14. The developing device of claim 12, wherein the discharge opening in the toner cartridge and the toner charging opening in the agitating chamber are centrally located, wherein the high wall portion is centrally located along the partition member, and wherein the partition member further comprises first and second low wall portions located on opposite sides of the high wall portion.

15. The developing device of claim 8, wherein a height of the high wall portion is greater than a height of a lower edge of the toner charging opening.

16. The developing device of claim 8, wherein the agitating chamber further comprises a recycled toner aperture, and wherein recycled toner may be supplied to the agitating chamber through the recycled toner aperture.

17. The developing device of claim 1, wherein the first agitating member is rotatably mounted in the developing chamber, wherein the partition member comprises at least one high wall portion and at least one low wall portion, and wherein a height of at least one of the at least one high wall portion and the at least one low wall portion is greater than a height of the locus of rotation of the first agitating member.

18. The developing device of claim 1, further comprising a restriction member mounted between the developing sleeve and the second agitating member, the restriction member preventing toner from moving from the agitating chamber directly onto the developing sleeve.

19. The developing device of claim 1, wherein the second agitating member is rotatably mounted in the agitating chamber, and wherein a portion of the partition member adjacent the second agitating member has an arcuate shape that conforms to the locus of rotation of the second agitating member.

20. The developing device of claim 1, wherein the first agitating member is rotatably mounted in the developing chamber, and wherein a portion of the partition member adjacent the first agitating member has an arcuate shape that conforms to the locus of rotation of the first agitating member.

21. The developing device of claim 1, wherein the partition member comprises at least one high wall portion and at least one low wall portion, wherein a thickness of an upper portion of the partition member is smaller than a thickness of a lower portion of the partition member, and wherein the upper portion of the at least one low wall portion comprises a pointed edge so that no toner can collect on a top surface of the at least one low wall portion.

22. A developing device, comprising:

a developing chamber confronting a photosensitive drum;

an agitating chamber having an agitating member mounted therein, wherein toner is supplied to the agitating chamber from a toner source, and wherein toner is supplied from the agitating chamber to the developing chamber by operation of the agitating member; and a partition member located between the agitating chamber and the developing chamber, the partition member having a height that varies along a length of the partition member such that at all points along the length thereof toner can be supplied by the agitating member over the partition member from the agitation chamber to the developing chamber.

23. The developing device of claim 22, wherein the agitating chamber further comprises a toner charging opening that is centrally located in the agitating chamber, wherein toner is supplied to the agitating chamber through the toner charging opening, and wherein the partition member includes a high wall portion centrally located on the partition member to confront the toner charging opening, and first and second low wall portions located on opposite sides of the high wall portion.

24. The device of claim 23, wherein a height of the high wall portion is substantially equal to or greater than a height of a lower edge of the toner charging opening, and wherein a width of the high wall portion is substantially equal to a width of the toner charging opening.

25. The device of claim 23, wherein the toner source comprises a toner cartridge, wherein toner is supplied to the agitating chamber from a discharge opening in the toner cartridge, the discharge opening in the toner cartridge being aligned with the toner charging opening in the agitating chamber and having a size that is equal to or less than a size of the toner charging opening, and wherein a width of the high wall portion is substantially equal to or greater than a width of the discharge opening in the toner cartridge.

26. The device of claim 25, wherein a height of the high wall portion is substantially equal to a height of a lower edge of the discharge opening in the toner cartridge.

27. The developing device of claim 22, wherein the partition member comprises at least one high wall portion and at least one low wall portion, wherein a thickness of an upper portion of the partition member is smaller than a thickness of a lower portion of the partition member, and wherein the upper portion of the at least one low wall portion comprises a pointed edge so that no toner can collect on a top surface of the at least one low wall portion.

* * * * *